US006213802B1

(12) United States Patent
Wu et al.

(10) Patent No.: US 6,213,802 B1
(45) Date of Patent: Apr. 10, 2001

(54) ELECTRICAL CONNECTOR

(75) Inventors: Ming Chuan Wu, Tai-Chung; Da Ching Lee, Su-Lin, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/430,360

(22) Filed: Oct. 28, 1999

(30) Foreign Application Priority Data

Jun. 8, 1999 (TW) ..... 88203950

(51) Int. Cl.[7] ..... H01R 12/24
(52) U.S. Cl. ..... 439/260; 439/492
(58) Field of Search ..... 439/67, 77, 492, 439/329, 495, 499, 260

(56) References Cited

U.S. PATENT DOCUMENTS 5,695,360 * 12/1997 Seto et al. ..... 439/260
5,738,545 * 4/1998 Igarashi et al. ..... 439/492
5,842,883 * 12/1998 Igarashi et al. ..... 439/260

* cited by examiner

*Primary Examiner*—Gary F. Paumen
(74) *Attorney, Agent, or Firm*—Wei Te Chung

(57) ABSTRACT

An electrical connector for connection with a flexible cable comprises an elongate insulative housing, a plurality of terminals retained in the housing and a stuffer. A pair of retention holes is formed at opposite ends of the stuffer corresponding to teeth at opposite ends of the housing. Each terminal includes a mating end and a mounting tail upwardly deformed. The stuffer is mounted to the housing with the teeth engaging in the holes. An end of the flexible cable is inserted into the connector for contacting the terminals. The stuffer is downwardly pushed to press against the flexible cable to engage with the mounting portions and secure the end of the flexible cable within the housing.

6 Claims, 8 Drawing Sheets

ELECTRICAL CONNECTOR

BACKGROUND OF THE INVENTION

The present invention relates to an electrical connector, and especially to an electrical connector for connection with a flexible cable having a stuffer for pressing the flexible cable to engage with terminals of the electrical connector.

When a pair of devices to be connected is individually assembled into a computer enclosure and is required to be replaced by an alternative counterpart, a permanent connection method such as soldering is unfavorable. A flexible cable, such as an FPC (Flexible Printed Circuit) or an FFC (Flexible Flat Cable), for providing releasable electrical connection between the devices is one solution for the above problem. The flexible cable is especially useful within a narrow or complicated space of a computer enclosure due to the high adaptability thereof.

A conventional connector such as the one disclosed in U.S. Pat. No. 5,738,545 is connected to a flexible cable by pivotally pressing the flexible cable against a plurality of terminals. Therefore, the terminals are connected to the flexible cable and the flexible cable is secured within the connector. However, the pivotal movement requires an actuation space thereby possibly interfering with the other devices within the computer enclosure. In addition, pivotally pressing the flexible cable is likely to cause a frictional sliding of a surface of the flexible cable thereby possibly damaging the flexible cable. Furthermore, the sliding movement of the flexible cable due to the pivotal pressing may cause circuit tracks on the flexible cable to be inaccurately engaged with the corresponding terminals. Thus, false signals may be generated in the circuits. In a worse case, the circuit or a component connected to the circuits may be damaged due to overheating caused by the inaccurate engagement between the flexible cable and the connector.

Furthermore, due to current trends, different components of a device are manufactured at different plants. The components are then transported to another plant to complete assembly of the device. Thus, a structure of each component must be suitable for long distance transport. However, a member pivotally mounted to the connector may become damaged during shipping by impacting other parts of the connector or unexpected objects outside the connector.

SUMMARY OF THE INVENTION

Accordingly, a primary object of the present invention is to provide an electrical connector for connection with a flexible cable having a stuffer for pressing against the flexible cable to contact terminals of the connector.

Another object of the present invention is to provide an electrical connector for connection with a flexible cable having a stuffer that can be easily disassembled therefrom for shipping purposes.

A further object of the present invention is to provide an electrical connector which can be reliably and properly connected to a flexible cable.

To fulfill the above-mentioned objects, an electrical connector for connection with a flexible cable comprises an elongate insulative housing, a plurality of terminals retained in the housing and a stuffer. The housing defines a plurality of passageways between a mating surface and a mounting surface opposite the mating for receiving the terminals. A pair of retention holes is formed in opposite ends of the stuffer corresponding to teeth formed on opposite ends of the housing. Each terminal includes a mating end and an upwardly extending mounting tail. The stuffer is mounted to the housing with the teeth engaging in the holes. A gap is defined between the mating tails of the terminals and the stuffer for receiving an end of the flexible cable with the mating tails contacting corresponding circuit tracks of the flexible cable. The stuffer is downwardly pushed to press against the flexible cable to engage with the mounting portions and secure the end of the flexible cable within the housing.

Other objects, advantages and novel features of the invention will become more apparent from the following detailed description when taken in conjunction with the accompanying drawings.

BRIEF DESCRIPTION OF THE DRAWINGIG

DETAILED DESCRIPTION OF A PREFERRED EMBODIMENT

Figure 1:
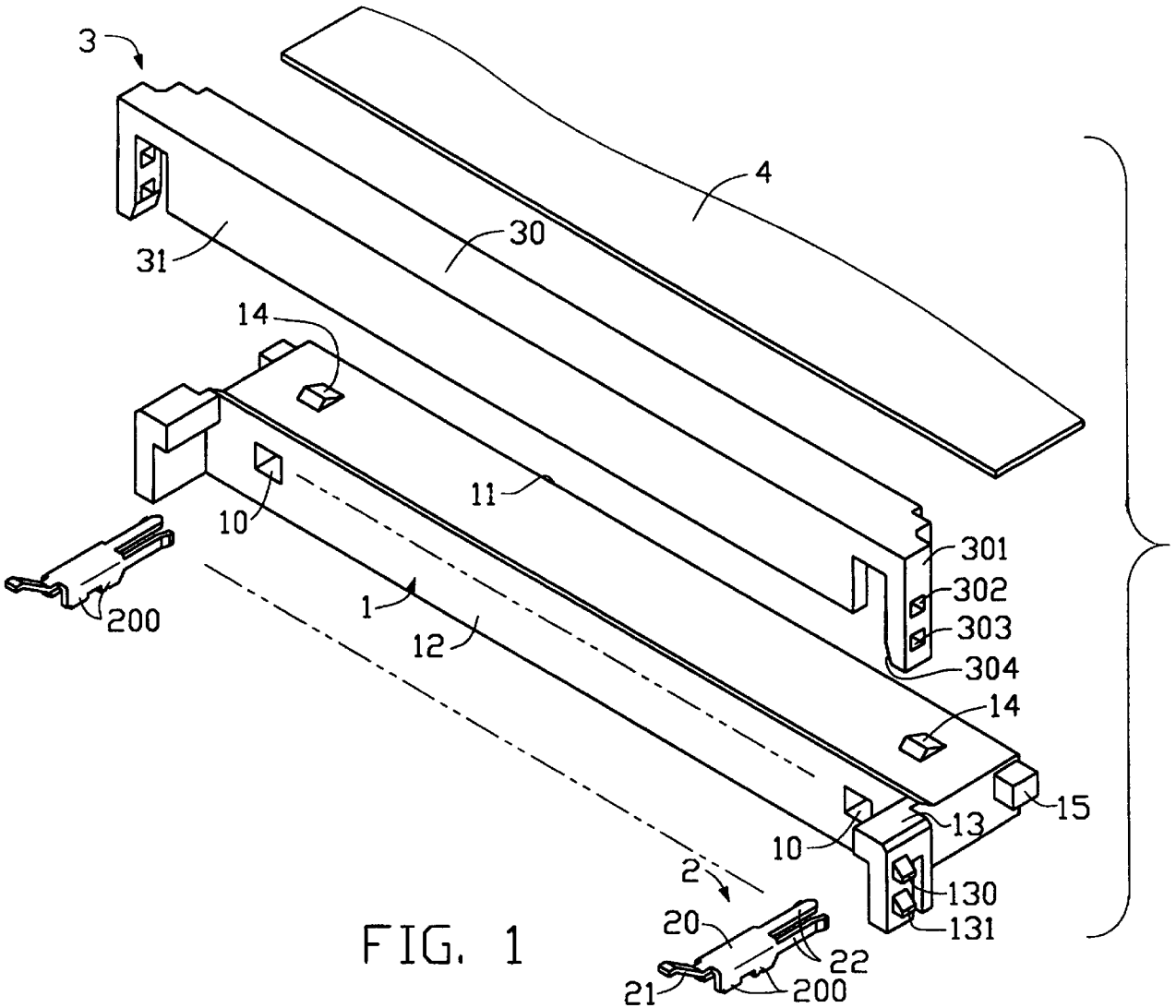
FIG. 1 is an exploded view of an electrical connector in accordance with the present invention and a flexible cable.

Referring to FIG. 1, an electrical connector 5 in accordance with the present invention comprises an elongate housing 1, a plurality of terminals 2 and an insulative stuffer 3.

Figure 5:
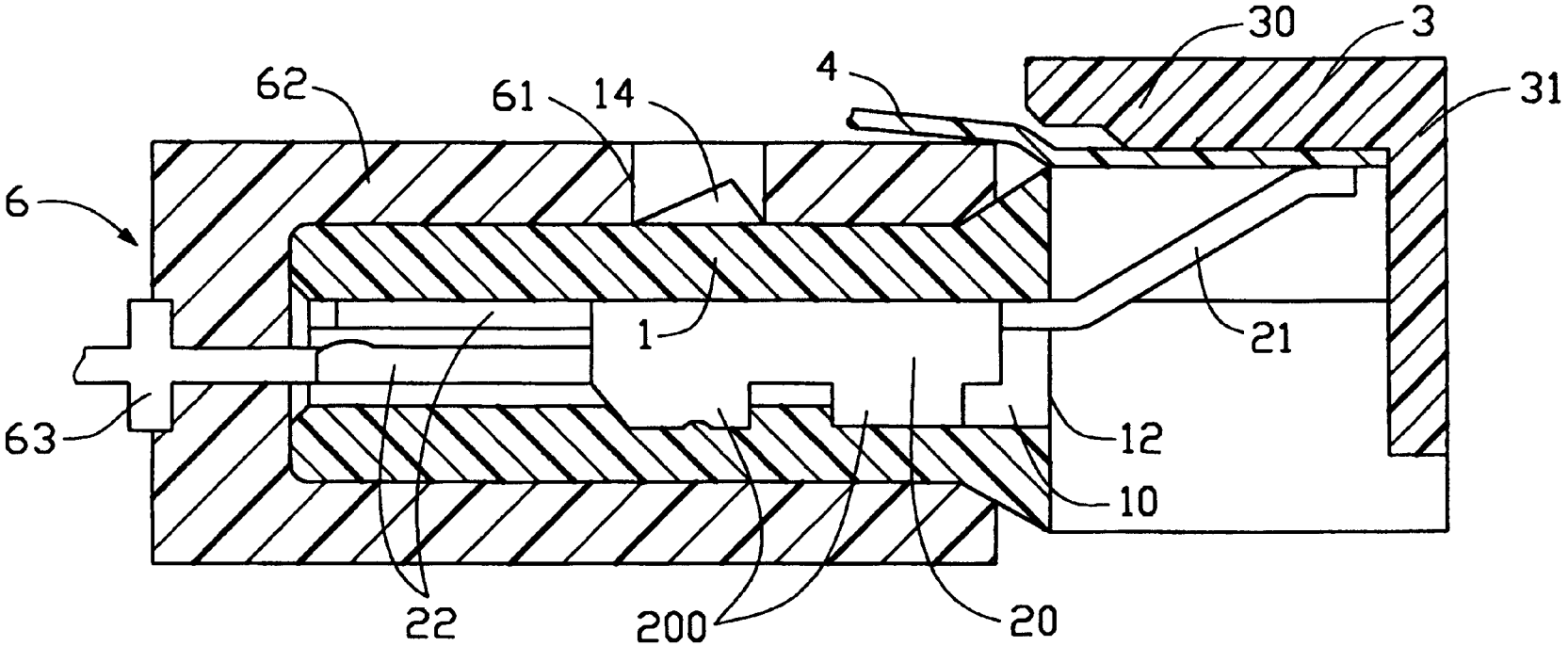
FIG. 5 is a cross-sectional view of FIG. 4 with a second connector mated to the electrical connector.

The housing 1 defines a plurality of passageways 10 between a mating surface 11 and a mounting surface 12 thereof. A pair of retention member 13 rearwardly extends from opposite ends of the housing 1. A first tooth 130 and a second tooth 131 are formed in vertical alignment on an outer surface of each retention member 13. An inclined surface is formed on each tooth 130, 131. A pair of projections 14 with inclined surfaces is formed on an upper surface of the housing 1. A pair of blocks 15 outwardly projects from opposite end of the housing 1 for orienting purposes when the electrical connector 5 mates with a mating connector 6 (FIG. 5).

The stuffer 3 includes an elongate body 30, a stop wall 31 and a pair of spring arms 301 at opposite ends of the stop wall 31. The distance between opposite inner surfaces of the arms 301 is substantially equal to the distance between opposite outer surfaces of the retention members 13. Each arm 301 defines a first hole 302 and second hole 303 therethrough. The first hole 302 and the second hole 303 are vertically aligned corresponding to the first tooth 130 and the second tooth 131 of the housing 1. An inclined surface 304 is formed on each arm 301 proximate a distal end thereof for facilitating connection between the stuffer 3 and the housing 1.

Each terminal 2 is unitarily stamped and forms a center portion 20, three mating ends 22 extending from one end of the center portion 20 and a mating tail 21 upwardly extending from an opposite end of the center portion 20. The mating tail 21 is upwardly deformed. Locking barbs 200 are formed along lateral edges of the center portion 20 for having an interference fit in the passageways 10 of the housing 1. The mating tails 21 extend out of the passageways 10 beyond the mounting surface 12 of the housing 1.

Figure 2:
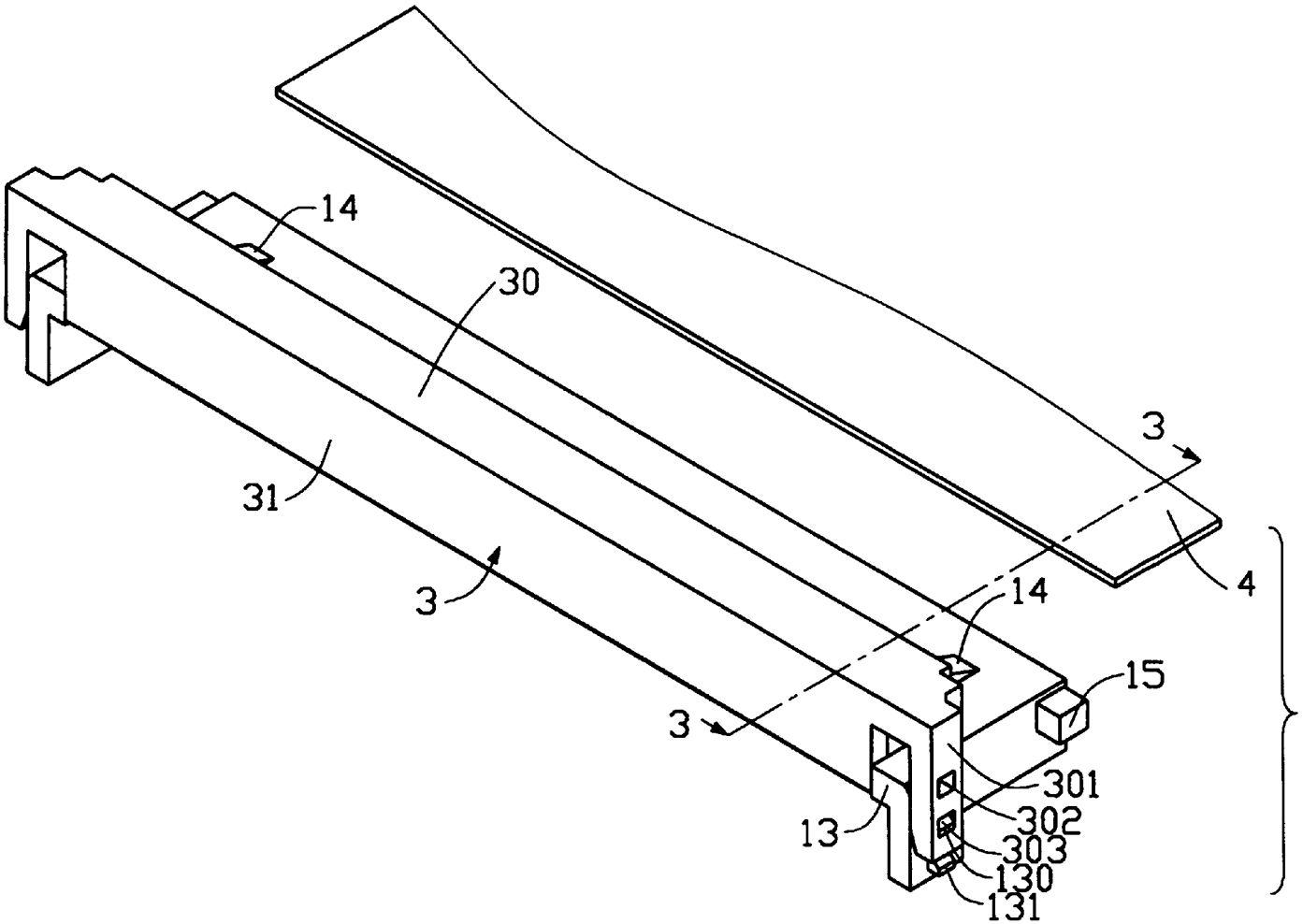
FIG. 2 is an assembled view of FIG. 1 with the flexible cable not yet inserted into the connector.
Figure 3:
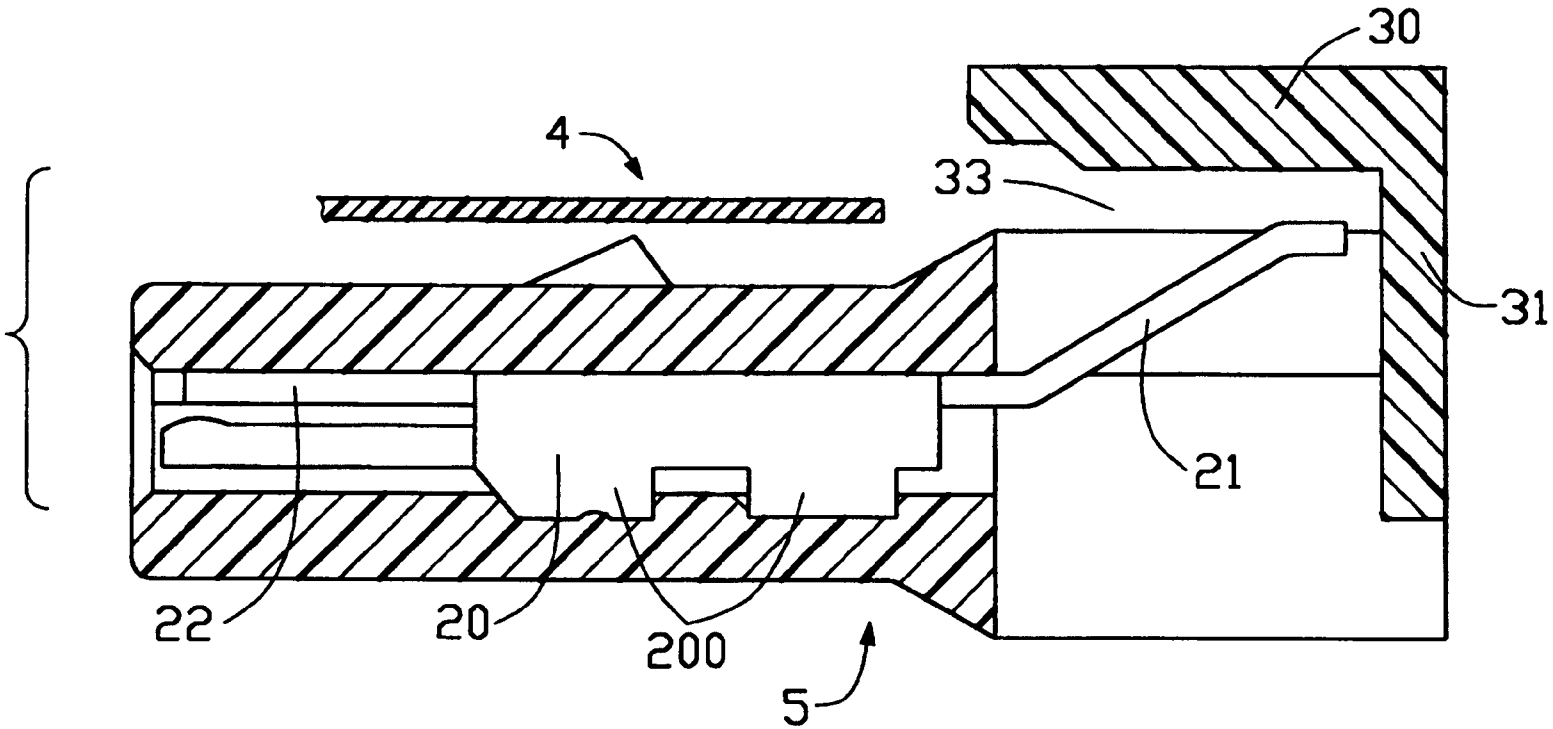
FIG. 3 is a cross-sectional view taken along line 3—3 of FIG. 2.

Referring to FIG. 2, in assembly, the stuffer 3 is mounted to the housing 1 with the first tooth 130 engaging in the second hole 303. As shown in FIG. 3, a gap 33 is defined between a bottom surface of the body 30 and the mating tails 21 for receiving an end of a flexible cable 4.

Figure 4:
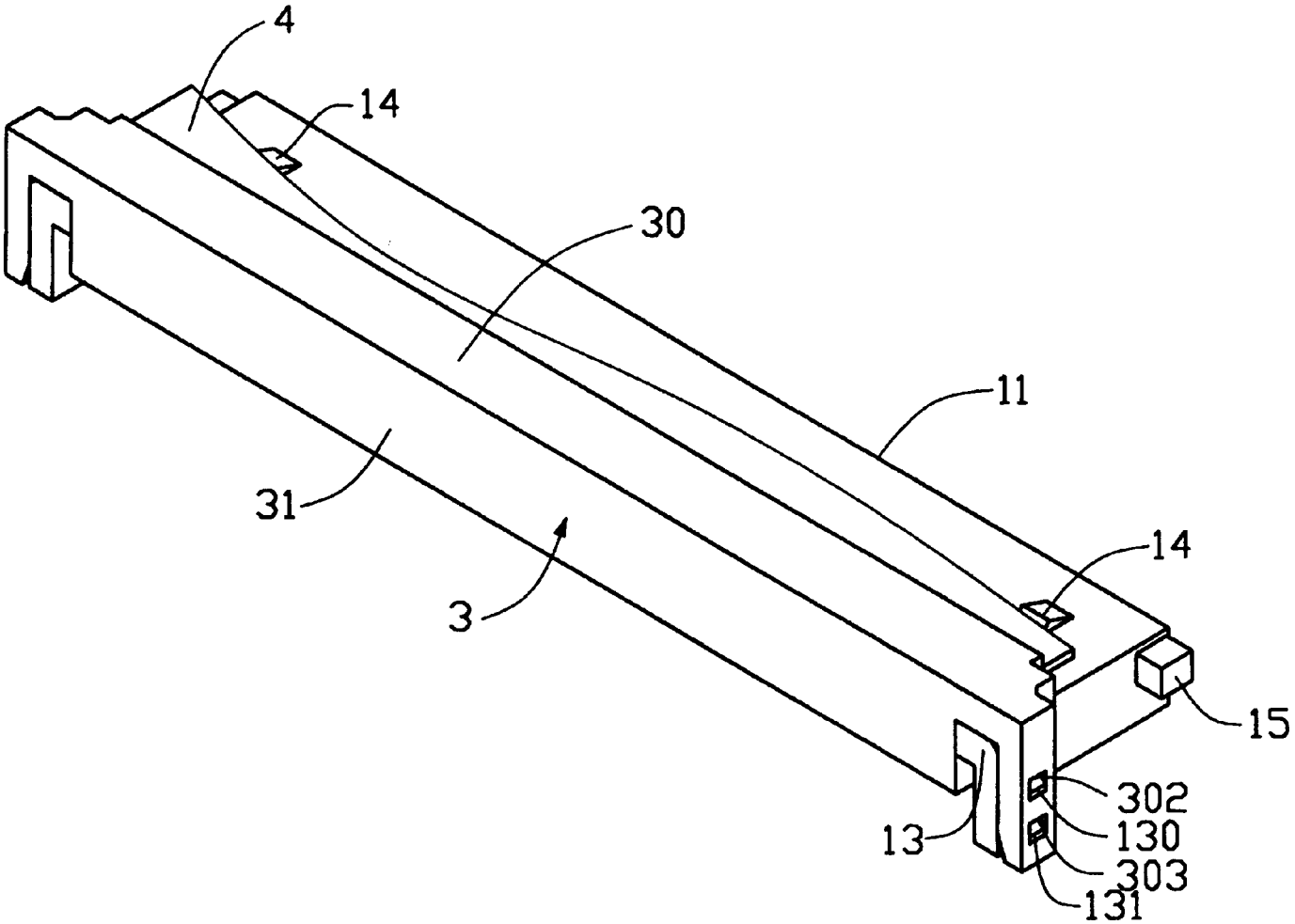
FIG. 4 is similar to FIG. 2 with the flexible cable inserted into the connector.

Also referring to FIGS. 4 and 5, the flexible cable 4 is inserted into the gap 33 with the mating tails 21 contacting corresponding circuit tracks (not shown) of the flexible cable 21. The stop wall 31 of the stuffer 3 is used for abutting an end of the flexible cable 4 entering the connector thereby properly positioning the flexible cable 4 between the housing 1 and the stuffer 3. The stuffer 3 is then downwardly pushed such that the first tooth 130 engages with the first hole 302 and the second tooth 131 engages with the second hole 303. The bottom surface of the body 30 abuts against the flexible cable 4 to ensure the circuit tracks of the flexible cable to reliably and accurately engage with the mating tails 21.

The mating connector 6 includes a plurality of contacts 63 for engaging with the mating ends 22 of the terminals 2 and a mating housing 62 for receiving the housing 1. The projections 14 engage with corresponding apertures 61 defined in the mating housing 62 thereby securing the electrical connector 5 to the mating connector 6.

Figure 6:
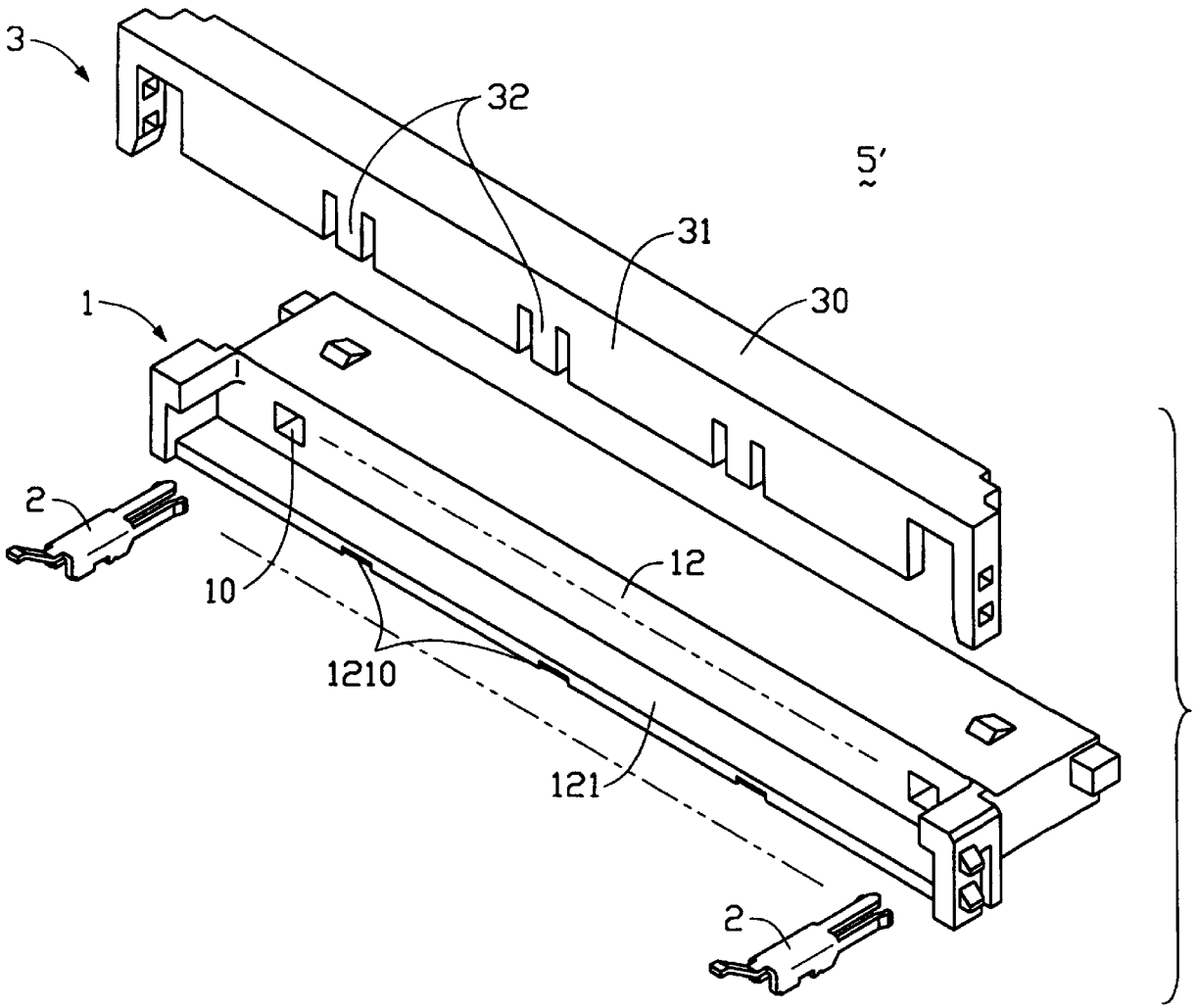
FIG. 6 is an exploded view of an electrical connector of a second embodiment of the present invention.
Figure 7:
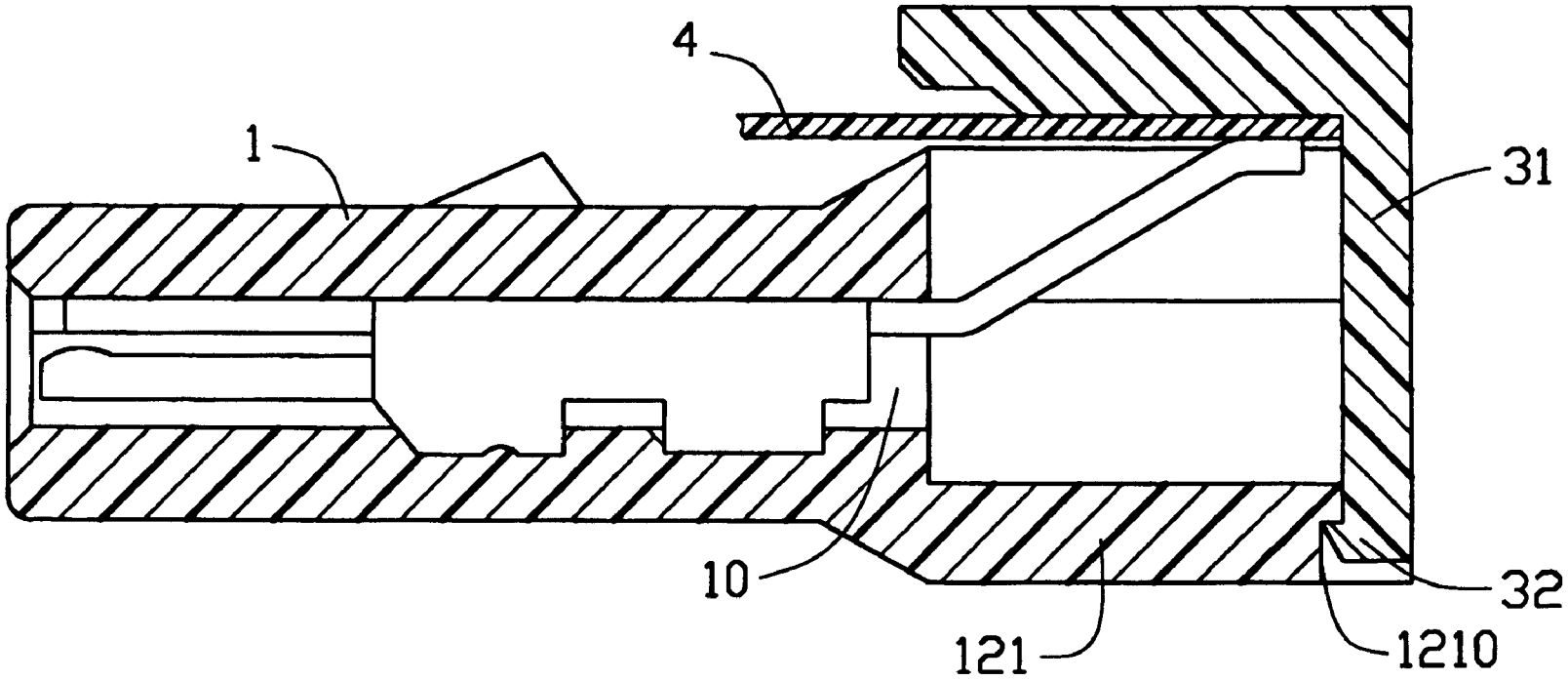
FIG. 7 is a cross-sectional view of the assembled connector of FIG. 6 with a flexible cable inserted therein.

FIGS. 6 and 7 show an electrical connector 5' of a second embodiment of the present invention. The differences between the electrical connector 5' of the second embodiment and the electrical connector 5 of the first embodiment reside in a portion of the stuffer 3 and a portion of the housing 1. Therefore, the reference numerals applied in FIGS. 1–5 are used to designate like components of the electrical connector 5'. The stuffer 3 forms a plurality of hooks 32 proximate a bottom edge thereof. Correspondingly, an elongate plate 121 extending from the mounting surface 12 of the housing 1 defines a plurality of recesses 1210 along an edge thereof. In assembly, the flexible cable 4 is retained in the housing 1 by the stuffer 3 and is connected to the terminals 2. The hooks 32 of the stuffer 3 engage with the recesses 1210 of the housing 1 thereby further securing the stuffer 3 to the housing 1.

Figure 8:
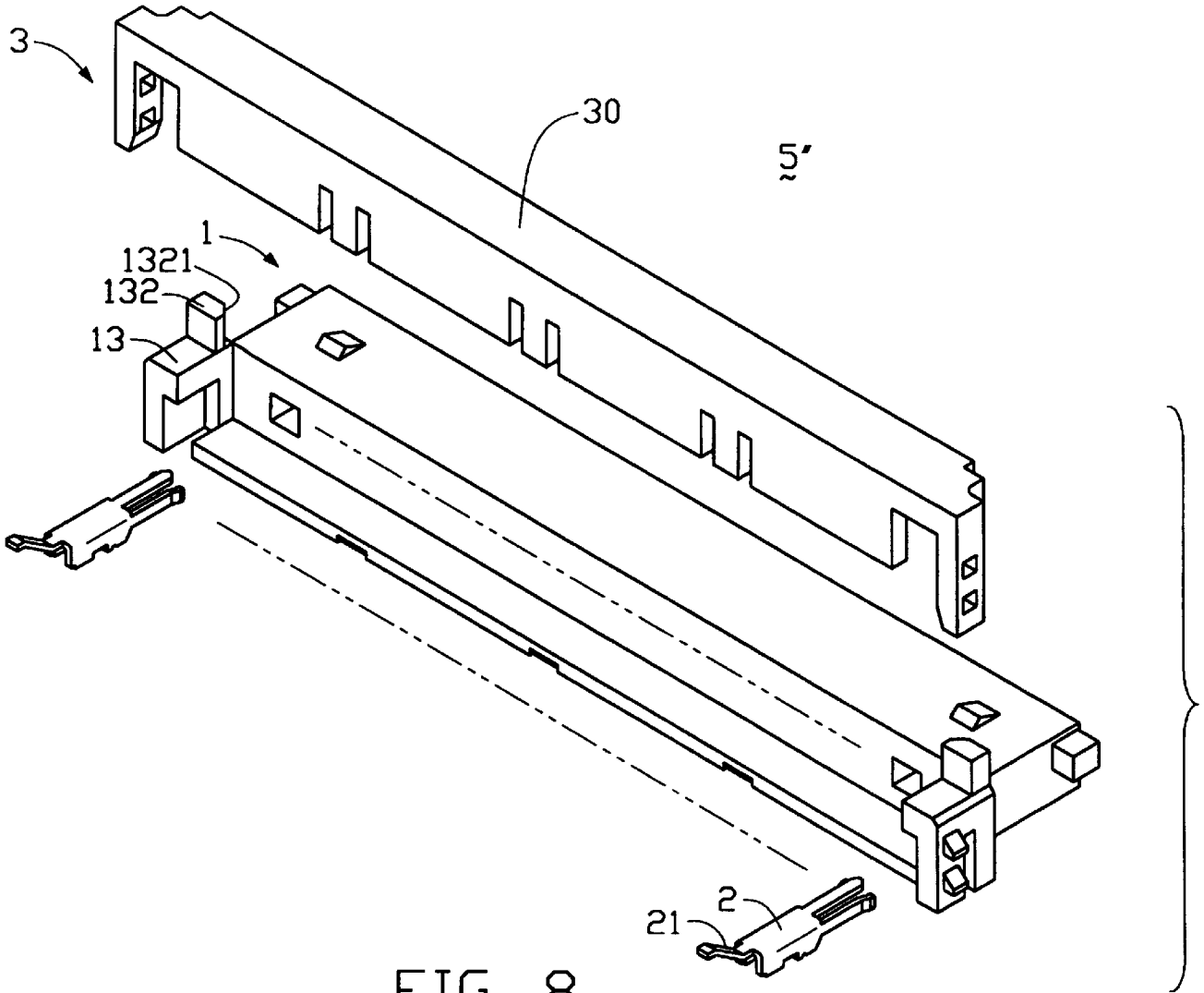
FIG. 8 is an exploded view of an electrical connector of a third embodiment of the present invention.

FIG. 8 shows an electrical connector 5" of a third embodiment of the present invention. The differences between the electrical connector 5" of the third embodiment and the electrical connector 5' of the second embodiment reside in a portion of the housing 1. Therefore, the reference having been applied in FIGS. 1–7 are used to designate like components of the electrical connector 5". A guiding post 132 upwardly projects from each retention member 13 of the housing 1. An inner inclined surface 1321 is formed on the guiding post 132. The guiding posts 132 are used for preventing transverse movement of the flexible cable 4 thereby properly positioning the flexible cable 4 between the housing 1 and the stuffer 3.

Since the stuffer 3 downwardly presses the flexible cable 4, frictional sliding on a surface of the flexible cable 4 is prevented. Thus, the surface is unlikely to be damaged. In addition, the flexible cable 4 is inserted into the electrical connector 5" and is guided by the stop wall 31 and the guiding posts 132. The circuit tracks on the flexible cable 4 can be properly engaged with the mating tails 21 of the terminals 2 and generation of false signals is prevented.

When the finished connector 5 is required to be transported, the stuffer 3 may be disassembled from each connector 5. Since the stuffer 3 is not pivotally mounted to the housing 1, the stuffer 3 would not be damaged by being impacted by other parts of the connector 5 or unexpected objects outside the connector 5 due to vibration. Alternatively, the finished connector 5 may be transported without disassembling the stuffer 3 since the stuffer 3 can be reliably secured to the housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a flexible cable to a mating connector, comprising:

an insulative housing having a mating surface and a mounting surface opposite the mating surface, the housing defining a plurality of passageways between the mating surface and the mounting surface;

a plurality of terminals retained in the passageways, each terminal including a mating end and a mating tail opposite the mating end, the mating end being disposed proximate the mating surface for engaging with the mating connector, the mating tails being disposed proximate the mounting surface; and a stuffer non pivotally secured to the housing in a direction normal thereto and pressing a distal end of the flexible cable against the mounting tails of the terminals while remaining portions of the cable extend toward the mating surface;

wherein the stuffer includes a body portion for pressing against the flexible cable and a stop wall for preventing movement of the flexible cable thereby properly positioning the flexible cable between the housing and the stuffer;

wherein a guiding post is formed at each end of the housing for preventing transverse movement of the flexible cable thereby properly positioning the flexible cable between the housing and the stuffer;

wherein an inclined surface is formed on each guiding post for facilitating insertion of the flexible cable into a gap defined between the housing and the stuffer;

wherein a pair of projections is formed on a top surface of the housing for latching a mating connector;

wherein a block outwardly projects from each end of the housing for guidingly mating with a mating connector;

wherein each terminal includes a center portion between the mating end and the mating tail with a plurality of locking barbs formed thereon;

wherein the mating tail of each terminal has an upwardly bent end.

2. The electrical connector as claimed in claim 1, wherein the housing comprises a retention member projecting at an end thereof and forming a pair of teeth; and the stuffer comprises a spring arm formed at an end thereof and defining a pair of holes corresponding to the teeth, the teeth being adapted to engage with the holes thereby securing the stuffer to the housing.

3. The electrical connector as claimed in claim 2, wherein the pair of teeth and the pair of holes are vertically aligned.

4. The electrical connector as claimed in claim 2, wherein each tooth forms an inclined surface for facilitating engagement between the tooth and the corresponding hole.

5. The electrical connector as claimed in claim 1, wherein a plurality of hooks is formed on the stop wall, and wherein the housing defines a plurality of recesses, the hooks being adapted to engage with the recesses for securing the stuffer to the housing.

6. An electrical connector assembly comprising:

a first connector defining an insulative housing having a mating surface and a mounting surface opposite to each other with a plurality of first terminals therein;

each of said first terminals defining a mating end and a mating tail offset toward an upper side of the housing;

a second connector with a plurality of second terminals therein and coupled to said first connector with the first and second terminals contacted with each other around said mating surface;

a stuffer non-pivotally secured to the housing in a direction normal thereto, from an upper side thereof, around the mounting surface; and a flexible cable including an tip portion sandwiched between said stuffer and the housing and mechanically and electrically engaged with the corresponding mating tails of the first terminals, and remaining portions of the flexible cable extending toward the second connector;

wherein said housing further includes an elongated plate extending from the mounting surface with means to latch the stuffer thereto and cooperating with the stuffer to protectively shield the mating tails of the first terminals therebetween.

* * * * *